United States Patent [19]

Loring et al.

[11] Patent Number: 4,564,200

[45] Date of Patent: Jan. 14, 1986

[54] TETHERED RING GAME WITH HOOK CONFIGURATION

[76] Inventors: Wolson J. Loring, 1035 Mulberry St., Reading, Pa. 19604; Charles C. Schaedler, 310 Noble Ave., Shoemakersville, Pa. 19555

[21] Appl. No.: 681,934

[22] Filed: Dec. 14, 1984

[51] Int. Cl.[4] ..... A63B 67/06

[52] U.S. Cl. ..... 273/332

[58] Field of Search ..... 273/332

[56] References Cited

U.S. PATENT DOCUMENTS

| | | | |
|---|---|---|---|
| 292,899 | 2/1884 | Davies | 273/332 |
| 1,121,353 | 12/1914 | Grikscheit | 273/332 |
| 1,517,454 | 12/1924 | Platt | 273/332 |
| 2,942,886 | 6/1960 | Ackerman | 273/332 |
| 2,950,917 | 8/1960 | Lyon | 273/332 |
| 2,950,918 | 8/1960 | Lyon | 273/332 |
| 2,991,034 | 7/1961 | Lyon | 273/332 X |
| 3,009,702 | 11/1961 | Lyon | 273/332 |
| 3,520,535 | 7/1970 | Dubbs et al. | 273/332 |
| 4,120,498 | 10/1978 | Mutchler et al. | 273/332 |

*Primary Examiner*—William H. Grieb

*Attorney, Agent, or Firm*—Leonard M. Quittner

[57] ABSTRACT

A tethered ring game is disclosed wherein a scoring hook is formed of wire rod and has near its mounting portion a break of minimum radius which defines an obtuse angle with the mounting portion and has at a defined distance from the free end of the wire a sweep of circular arc such that a hook is formed at the free end portion, said arc being less than 180°. The hook may be mounted statically to an upright or motively to a counterclockwise rotable arm.

10 Claims, 10 Drawing Figures

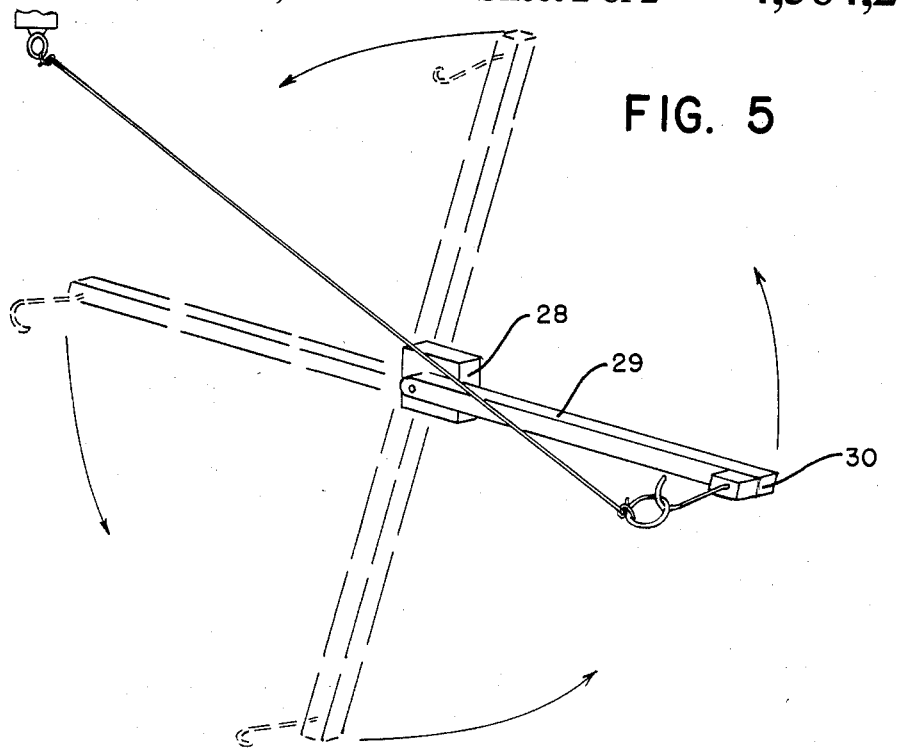
FIG. 5
FIG. 6a
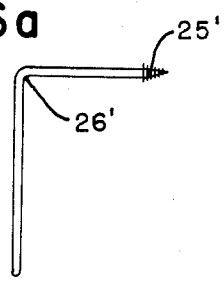
FIG. 7a
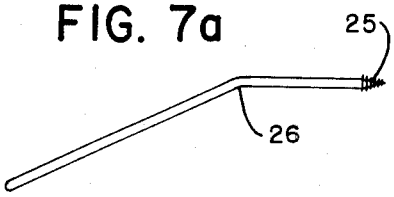
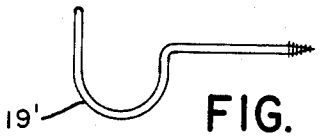
FIG. 6b
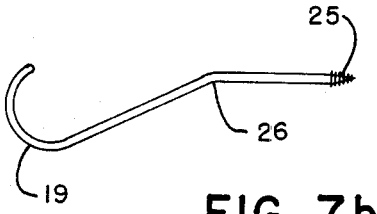
FIG. 7b
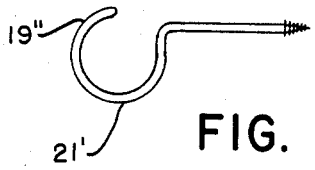
FIG. 6c

TETHERED RING GAME WITH HOOK CONFIGURATION

CROSS-REFERENCE

There are no cross-reference to, nor are there any, related applications.

FEDERALLY-SPONSORED RIGHTS

The invention herein was made without any Federal sponsorship or contribution.

BACKGROUND OF THE INVENTION

1. The Field of the Invention

The field of the invention relates tethered ring games and more particularly the configuration of the hook toward which the ring is propelled to be snared in play whereby the skill required to play the game is considerably enhanced.

2. Description of the Prior Art

The prior art is best demonstrated by U.S. Pat. Nos. 2,950,917 to Lyon (hereinafter "'917"), 2,950,918, also to Lyon, (hereinafter "'918"), 2,991,034, also to Lyon, (hereinafter "'034"), 3,009,702, also to Lyon, (hereinafter "'702"), 3,520,535 to Dibbs (hereinafter "'535") and 2,942,886 to Ackerman (hereinafter "'886"), '917 teaches a free-standing assembly with a cantilevered arm to which is suspended a ring by means of a tether such as a string. Also taught is the use of a multiplicity of gooseneck hooks mounted serially in an arctuate plane approximating the arc of the tethered ring when swung. This is accomplished by mounting at the base of the assembly the hooks on an arctuate surface with a radius comparable to that of the length of the tether or by serially stepping the hooks outwardly on an inclined flat surface each hook with an increasing shank length. No further consideration is given to hook construction nor is any taught. '918 to the same inventor utilizes but one hook which is of gooseneck construction. The invention pertains essentially to the collapisibility of the cantilever. In '034, Lyon teaches a further feature of collapsibility and utilizes, for example, the inclined flat surface mounting of the hooks as in '917. Lyon teaches in '702 a collapsible cantilever to which is attached a tethered ring and a gooseneck hook mounted in perpendicular assembly with the base to which the cantilever is attached.

'535 teaches stepped gooseneck hooks of varing lengths mounted serially and in a common vertical plane, and a multiplicity of hooks in an array. Taught also is varying the distance of the tether restraint from the playing surface as are features in ring design and static hook rotation twisting prior to play.

'836 teaches an upwardly extending gooseneck hook in the arctuate plane of the tethered ring.

None of the foregoing prior art deals with critical aspects of hook construction which substantially and surprisingly increases the skill required to score. Many of the examples disclosed impose variations in layout, hook spacing, ring design and the like which attempt to increase such skill but, in fact, do not. The present invention discloses that a hook configuration specifically avoiding a gooseneck in a novel way and hook orientation are the prime aspects of increased skill and degree of difficulty play.

In each of the inventions described as representative of the prior art the hook is designed in the form of a gooseneck or partially opened eye. The distinction may best be understood by examining how a gooseneck hook is formed in the art. (FIGS. 6*a–c*). A right angle bend of minimum radius is taken in the mounting portion of the hook rod wire a defined distance from the mounting end thereof. Thereafter, at a point starting from the right angle a reverse arc of typically 270° is formed in two stages toward the free end. As is the case in the present invention, generally the diameter of the arc is selected as a convenience and may be related to the diameter of the rod wire which is usually small in relation thereto. A wire diameter of typically one eighth of an inch and a hook diameter of one inch is common.

The use of such a configuration, the gooseneck hook, actually diminishes the skill required to score.

SUMMARY OF THE INVENTION

The invention described herein is summarized by a ring made of a heavy material such as steel attached to a tether made of a dimensionably stable, flexible material such as braided nylon cord. The cord is attached to an overhead mounted pendulum base. This is affixed to an overhead or ceiling. The cord is a defined length from the base to the suspended ring, such length being equal to the distance between the pendulum base and a wall mounted hook which is at such an elevation from the floor that the tether is held reasonably taut. The hook is made of wire rod and is of a novel configuration such that in its mounting portion near its mounting end, a shallow break is formed of minimum radius defining an obtuse angle of 150° to 175° with the mounting portion and thereafter starting at a defined distance from the free end of the wire rod a sweep is formed of 150° to 175° circular arc.

A further embodiment of the present invention is to mount the hook assembly on the free end of an arm whose other end is mounted to a shaft of a motor, for example, of the windup type, having a counterclockwise rotation such that when the arm is in the 3 o'clock position the hook's opening is upright away from the floor and perpendicular thereto. Play is begun by starting the motor and timing the pendulous action of the ring to snare the hook. Further counterclockwise rotation of the arm will disengage the ring and put it back in play.

An object of the present invention is to increase the skill required of the player.

Another object is to improve the design of the hook in tethered ring games whereby the skill required of the player is increased.

A further object of the invention is to put the hook in motion thereby increasing the difficulty of play.

Other objects, advantages and features of the present invention will be apparent to those skilled in the art from the following description taken in conjunction with the accompanying drawings.

DESCRIPTION OF DRAWINGS

The present invention may be better understood by reference to the drawings wherein seven (7) numbered figures are shown on two (2) sheets. The numbers shown on the drawings for the various parts of the invention are consistent throughout so that a number indicating a part in one drawing will indicate the same part in another drawing.

FIG. 5 shows a hook assembly mounted to a counterclockwise moving rotary arm with ring ensnared.

FIG. 6 (*a–c*) shows the stepwise formation of a typical gooseneck ring as demonstrated in the prior art. FIG. 7 (*a–b*) shows the stepwise formation of a hook of the invention.

DESCRIPTION OF THE PREFERRED EMBODIMENT

Figure 1:
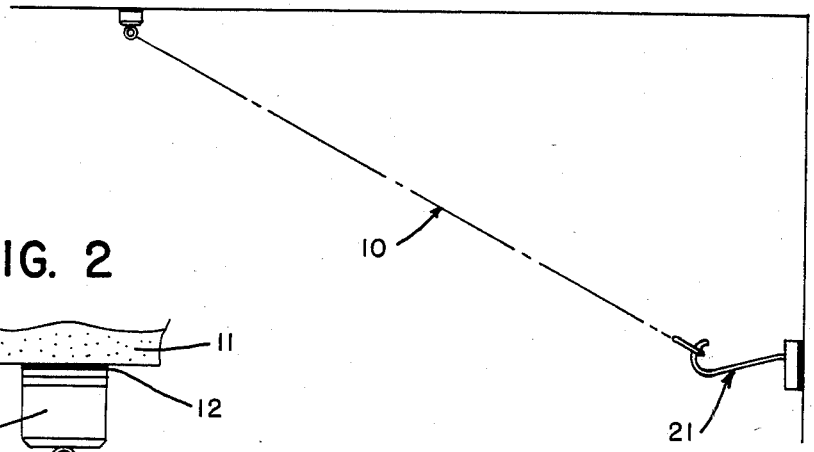
FIG. 1 depicts the tethered ring assembly mounted by its base to an overhead.
Figure 2:
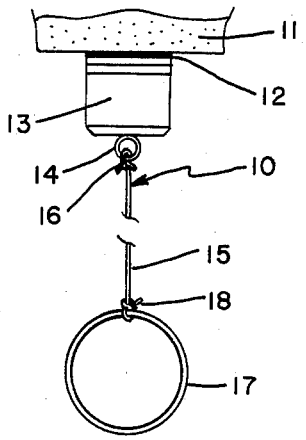
FIG. 2 shows a typical adhesive means of installing the ring assembly.
Figure 3:
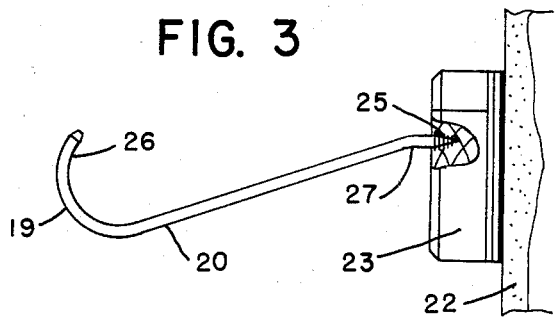
FIG. 3 shows a side view of the hook assembly.
Figure 4:
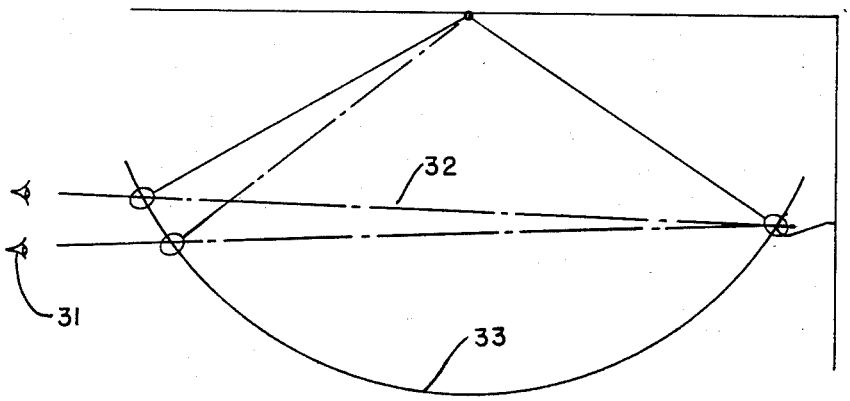
FIG. 4 shows a typical player's eye to hook alignment for aim prior to play.

The preferred embodiment is described as consisting of a ring assembly (10) attached to an overhead (11) or ceiling by adhesive means (12). The ring assembly consists of a cube shaped pendulum base member (13) having an screw eye (14) centrally installed in the face of the block opposite the side of block to which the adhesive is applied. A flexible tether member (15), typically a defined length of braided nylon cord is tied (16) to the eye at one end thereof and to a ring member (17) of a defined diameter at the other (18). The length of the tether is such that it reaches tautly (FIG. 1) from the pendulum base to a hook portion (19) of a hook member (20) in a hook assembly (21) mounted to an upright (22) or wall a defined elevation from the floor. The hook assembly consists of a hook block (23) in the shape of a rectangular plate which has on its face adjacent to the upright adhesive means (24) and has installed centrally disposed on its face opposite the adhesive the hook member having a mounting end, a mounting portion (25), the hook portion and a free end (26). On the mounting portion adjacent to the hook block is a break (27) with minimum radius defining an angle typically of 165° and 180° with the mounting portion. Thereafter, at a defined distance from the free end a sweep of 150° to 175° circular arc is formed to make the hook portion.

In comparison a prior art gooseneck (21') is formed with a right angle break (26') of minimum radius a defined distance from its mounting end (25'). Thereafter, starting at the break a 180° circular bend (19') is formed leaving a free end. The circular bend is continued (19'') to form the gooseneck whose arc is typically 270°.

In a further embodiment, a motor (28) attached to the upright and having typically a 3 RPM counterclockwise has attached to its shaft an arm (29) of defined length such that when the hook block is mounted to the arm's free end portion (30) the hook is upright when the arm is in a 3 o'clock position and the hook will be located at the same defined elevation from the floor as heretofore described.

Play is begun by a player lining up his eye (31) in line of sight (32) through the ring to the hook with the tether held tautly. The ring is then let go in a pendulous arc (33) such that the ring will swing toward the hook in its upright position whereby it will become snared by the hook for a score.

Since many modifications, variations and changes in detail may be made to the presently described embodiments, it is intended that all matter in the foregoing description and accompanying drawings be interpreted as illustrative and not by way of limitation.

What is claimed is:

1. A tethered ring game with a ring, a hook and a tether in combination comprising:

a. A ring assembly with a cube shaped pendulum base member with an overhead affixing means on its face adjacent to the overhead and which has disposed on its face opposite the adjacent face a tether connecting means connected to which is tied at a free end thereof a flexible tether of a defined length whose other end is tied to a ring, said length being such that the tether is tautly held from the pendulum base to b. a hook portion of a hook member in a hook assembly which is mounted to an upright by affixing means a defined elevation from a floor and in which the hook assembly consists of a rectangularly shaped plate which forms a hook block which has the upright affixing means on its face adjacent to the upright and has installed centrally on its face opposite the adjacent face a mounting portion of the hook member which mounting portion has therein contained a break of a minimum radius whereby an obtuse angle is formed with the mounting portion and having at a defined distance from a free end of the hook member a sweep of circular arc which is less than 180°.

2. A tethered ring game as in claim 1 wherein the break's obtuse angle is between 150° and 175°.

3. A tethered ring game as in claim 2 wherein the obtuse angle is 165°.

4. A tethered ring game as in claim 1 wherein the sweep arc is between 150° and 179°.

5. A tethered ring game as in claim 4 wherein the sweep arc is 165°.

6. A tethered ring game with a ring, a hook and a tether in combination comprising:

a. A ring assembly with a cube shaped pendulum base member with an overhead affixing means on its face adjacent to the overhead and which has disposed on its face opposite the adjacent face a tether connecting means connected to which is tied at a free end thereof a flexible tether of a defined length whose other end is tied to a ring, said length being such that when the tether is tautly held from the pendulum base to b. a hook portion of a hook member in a hook assembly which is mounted to an outer end of a counterclockwise motor driven arm with an outer surface and a wallside surface on a motor which is positioned a defined elevation from a floor and in which the hook assembly consists of a rectangularly shaped plate which forms a hook block which has included therein affixing means on its face adjacent to the outer surface of the arm and has installed centrally disposed on its face opposite the adjacent face a mounting portion of the hook member having a break of a minimum radius in said portion whereby an obtuse angle is formed with the mounting portion and having at a defined distance from a free end of the hook member a sweep of circular arc which is less than 180°.

7. A tethered ring game as in claim 6 wherein the break's obtuse angle is between 150° and 175°.

8. A tethered ring game as in claim 7 wherein the obtuse angle is 165°.

9. A tethered ring game as in claim 6 wherein the sweep arc is between 150° and 179°.

10. A tethered ring game as in claim 9 wherein the sweep arc is 165°.

* * * * *